US005906040A

United States Patent [19]

Kawano et al.

[11] Patent Number: 5,906,040

[45] Date of Patent: May 25, 1999

[54] METHOD AND APPARATUS FOR MANUFACTURING A MAGNETIC CORE

[75] Inventors: Keisuke Kawano, Kariya; Kazutoyo Oosuka, Gamagori; Masami Kojima, Chiryu, all of Japan

[73] Assignee: Denso Corporation, Kariya, Japan

[21] Appl. No.: 08/794,786

[22] Filed: Feb. 3, 1997

[30] Foreign Application Priority Data

Mar. 6, 1996 [JP] Japan ..... 8-049245

[51] Int. Cl.[6] ..... H01F 3/04

[52] U.S. Cl. ..... 29/738; 29/760

[58] Field of Search ..... 29/609, 738, 760; 414/788.1, 788.9, 791.5, 791.6, 794.7; 83/84, 86, 87, 88, 93, 96

[56] References Cited

U.S. PATENT DOCUMENTS 3,547,280 12/1970 Geigerich ..... 83/86

FOREIGN PATENT DOCUMENTS 50-88532 7/1975 Japan .
51-38624 3/1976 Japan .
57-138316 8/1982 Japan .
3-165505 7/1991 Japan .

*Primary Examiner*—Timothy V. Eley
*Assistant Examiner*—Benjamin M. Halpern
*Attorney, Agent, or Firm*—Pillsbury Madison & Sutro LLP

[57] ABSTRACT

A piling machine includes a table with a plurality of step-shelves, a slider and a stopper. One of a plurality of iron strips is placed in a prescribed order on each of the step-shelves, caught by the slider one by one, and piled together as the slider proceeds. When the slider is stopped by the stopper, all the strips are piled up to form a strip assembly. The stopper has a curved front surface to neatly hold the strip assembly, thereby easily forming the strip assembly into a desired shape.

7 Claims, 10 Drawing Sheets

METHOD AND APPARATUS FOR MANUFACTURING A MAGNETIC CORE

CROSS REFERENCE TO RELATED APPLICATION

The present application is based on and claims priority from Japanese Patent Application No. Hei 8-49245, filed on Mar. 6, 1996, the contents of which are incorporated herein by reference.

BACKGROUND OF THE INVENTION

1. Field of the Invention

The present invention relates to a method and apparatus for manufacturing a magnetic core and, particularly, for manufacturing a mangnetic core for an ignition coil for a vehicle.

2. Description of the Related Art

Usually, a mangnetic core of an ignition coil is composed of a plurality of laminated iron strips. JPA 3-165505 discloses a reactor core having an air gap composed of a plurality of laminated iron sheet blocks which are combined to form a generally cylindrical mangnetic core. In order to manufacture such a reactor core, a variety of iron sheets having different width are stamped out and piled up one by one to form a cylindrical periphery by using many press dies with many assembling steps.

SUMMARY OF THE INVENTION

The present invention has provides an improved method for manufacturing mangnetic cores which reduces the number of press dies and manufacturing steps.

A method for manufacturing a magnetic core according to the present invention comprises steps of cutting an iron sheet into a plurality of strips having different widths and a fixed length in a prescribed order; arranging each of the strips in the prescribed order; stacking the strips in the prescribed order to form a strip assembly; shaping the strip assembly into a prescribed shape; and fastening the strip assembly together.

The cutting step comprises a step of cutting an iron sheet longitudinally into a plurality of ribbons having different widths in the prescribed order.

The stacking step comprises the steps of catching one of the strip arranged in the prescribed order; dropping the strip on another strip to form a stack of the strips; catching the stack; dropping the stack on a next strip to form another stack of strips; repeating the steps of catching and dropping until a last strip is caught and stacked.

An apparatus according to the present invention includes a table for placing a plurality of iron strips in a prescribed order; a stacker for stacking the iron strips in the prescribed order; a mover for moving the a stacker relative to the table to supply the iron strips one by one to the stacker.

The table preferably includes a plurality of step shelves for holding each one of the strips in the prescribed order. The first means has a slider for catching one of the strips and stacks the strips which were caught when the slider is carried to one of the step-shelves by the second means.

The table preferably rises relative to the ground in a moving direction of the slider to hold the strips on each of the step shelves surely.

BRIEF DESCRIPTION OF THE DRAWINGS

Other objects, features and characteristics of the present invention as well as the functions of related parts of the present invention will become clear from a study of the following detailed description, the appended claims and the drawings. In the drawings:

DETAILED DESCRIPTION OF THE PREFERRED EMBODIMENTS

Figure 3:
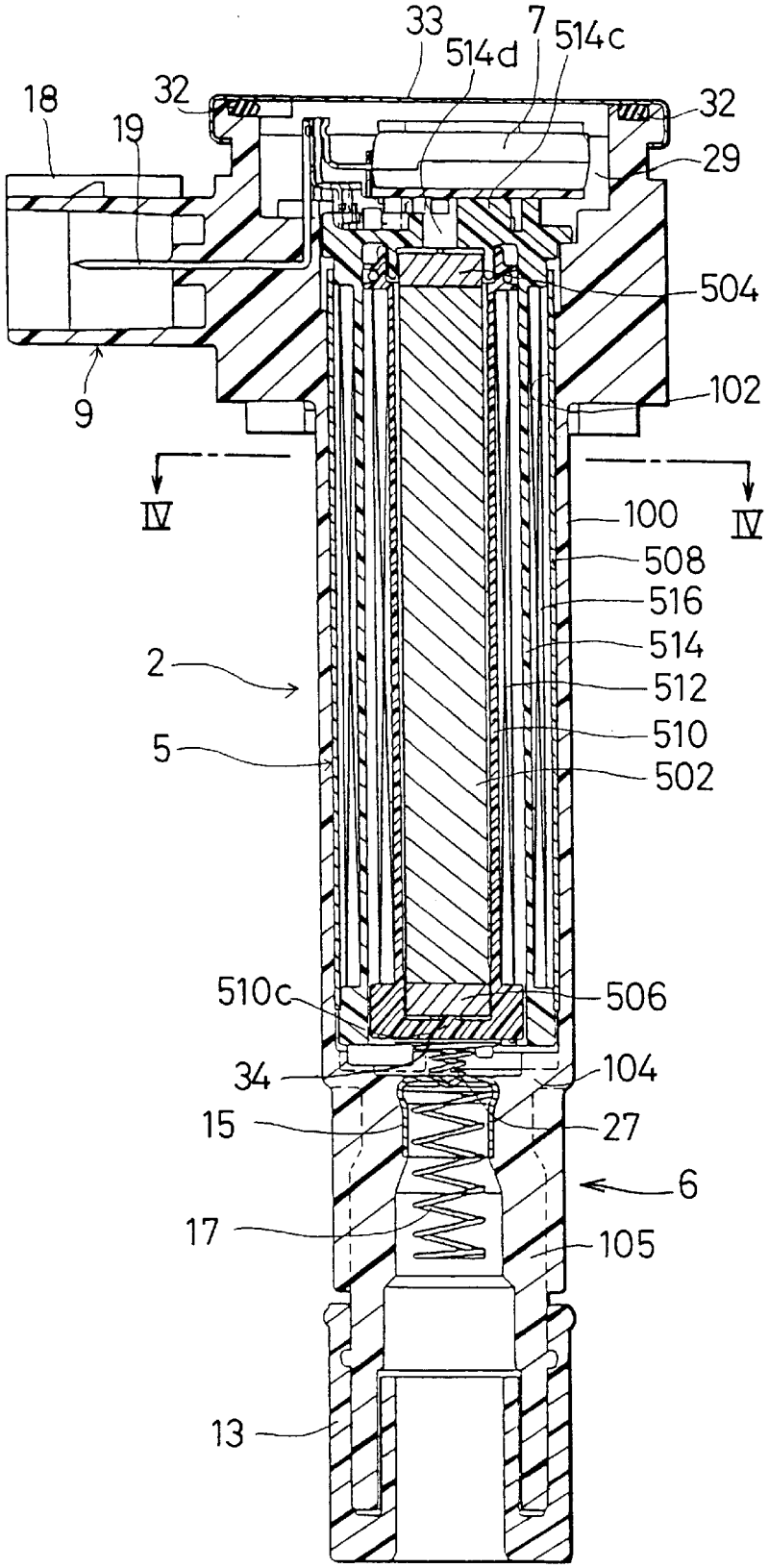
FIG. 3 is a cross-sectional view illustrating an ignition coil having a magnetic core manufactured by the apparatus according to the present invention.
Figure 4:
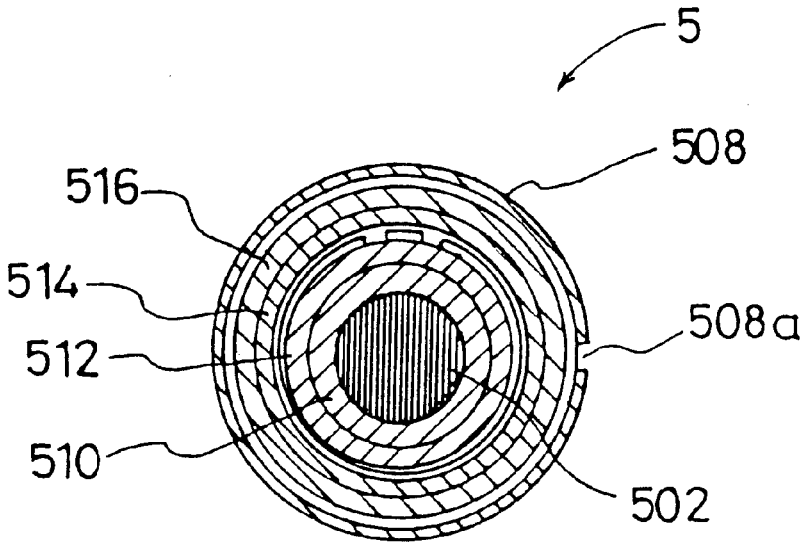
FIG. 4 is a cross-sectional plan view cut along a line IV—IV in FIG. 3.

An embodiment according to the present invention is described in conjunction with the appended figures;

As shown in FIGS. 3 and 4, an ignition coil 2 for a automotive vehicle is composed of a cylindrical transformer section 5, a control circuit 7 for switching on and off the primary current of the transformer section 5 and a terminal section 6 for supplying the secondary voltage to a spark plug.

The ignition coil 2 has a cylindrical case 100 made of a resinous material, which accommodates the transformer section 5, the control circuit 7 and insulating oil 29 in a chamber 102. A control-signal input-terminal 9 and an open end 100*a* of the chamber 102 are also formed on an upper portion of the case 100 on the chamber 102. The open end 100*a* is closed by a cover 32 which is caulked on an upper portion of the case 100. The bottom of the chamber 102 is hermetically closed by a cup 15 which is insert-molded into the case to be enclosed by the terminal section 6.

The control-signal input-terminal 9 is composed of a connector housing 18 and three connector pins 19. The connector housing 18 is molded together with the case 100 so that the connector pins 19 extend through the case 100 to the outside.

A cylindrical portion 105 for holding a spark plug (not shown) is formed at an end of the terminal section 6. The open end of the cylindrical portion 105 has a plug cap 13 fitted thereto.

A compressive spring 17 is attached to the bottom of the cup 15, which connects the spark plug with a secondary coil 512.

The transformer section includes a magnetic core 502, permanent magnets 504 and 506, a secondary spool 510, the secondary coil 512 a primary spool 514, and a primary coil 516.

Figure 5:
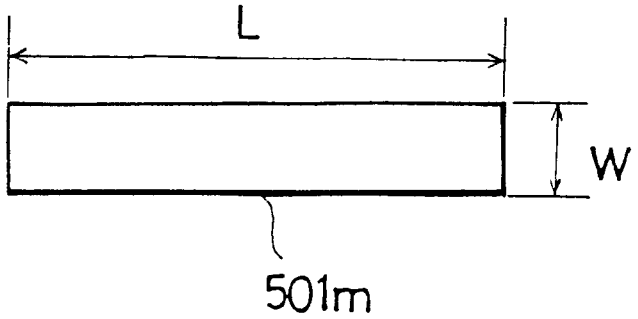
FIG. 5 is a schematic view of an iron strip.
Figure 6A:
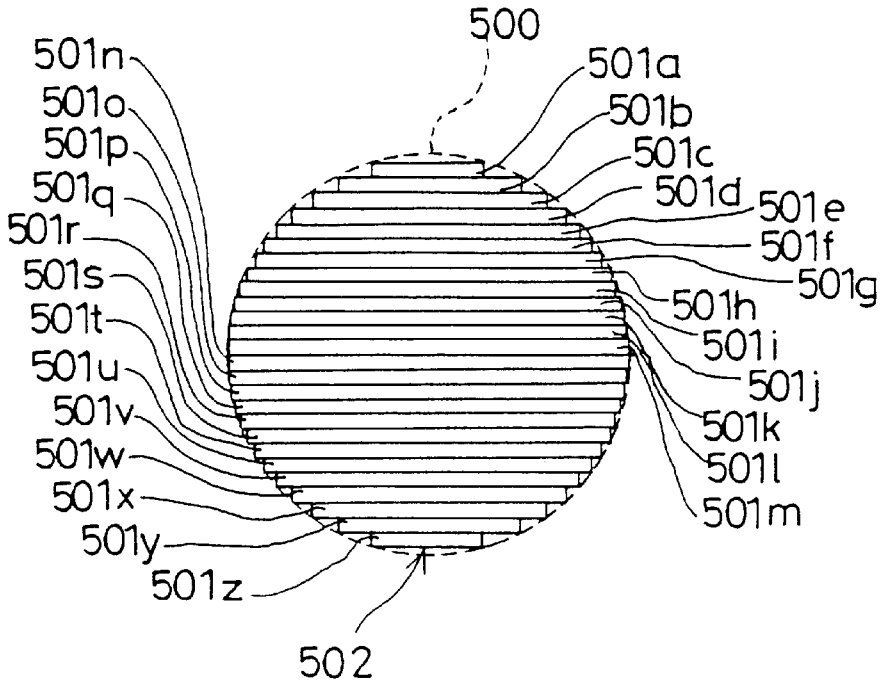
FIG. 6A is a cross-sectional plan view of a magnetic core manufactured by the apparatus according to the present invention and FIG. 6B is a side view of the magnetic core shown in FIG. 6A.

The magnetic core 502 is comprised of laminated silicon steel strips as shown in FIG. 5. They have a fixed length L and variety of widths W to form a cylindrical unit. For example, the magnetic core 502 is composed of gradually widening thirteen strips 501*a* (thinnest strip) to 501*m* (widest strip) with the width W ranging from 2.0 mm to 7.2 mm and gradually thinning thirteen strips 501*n* (widest strip) to 501*z* (thinnest strip) with the width of the same range as shown in FIG. 6A. If the thickness of the strips are 0.27 mm, the outside diameter of the magnetic core 502 becomes approximately 7.2 mm with the space factor (a ratio of the actual sectional area of the magnetic core 502 to the area of the complete circle surounding the same) of 95%.

Each strip of the magnetic core 502 is welded by a laser welder at opposite end portions thereof (not shown). The permanent magnetics 504 and 506 are disposed on the opposite ends of the magnetic core 502 so that their magnetic fluxes are oriented opposite the magnetic flux generated by the primary coil 516.

The secondary spool 510 is a cylindrical resinous member which has the secondary coil therearound. The secondary spool 510 has a bottom 510*c* on which a terminal plate 34 is fixed. The terminal plate 34 is connected to the secondary coil through a lead wire (not shown) and to the cup 15 by a compression coil spring 27, which is attached to the terminal plate 34.

Similarly, the primary spool 514 is a cylindrical resinous member which has an open end closed by a cover 514*c*. The primary coil 516 is wound around the primary spool 514.

An auxiliary core 508 having a plurality of slits surrounds the primary spool 514 to suppress leakage of the magnetic flux to the outside.

The chamber 102 is filled with the insulating oil 29 except a small space on the top thereof.

Figure 7:
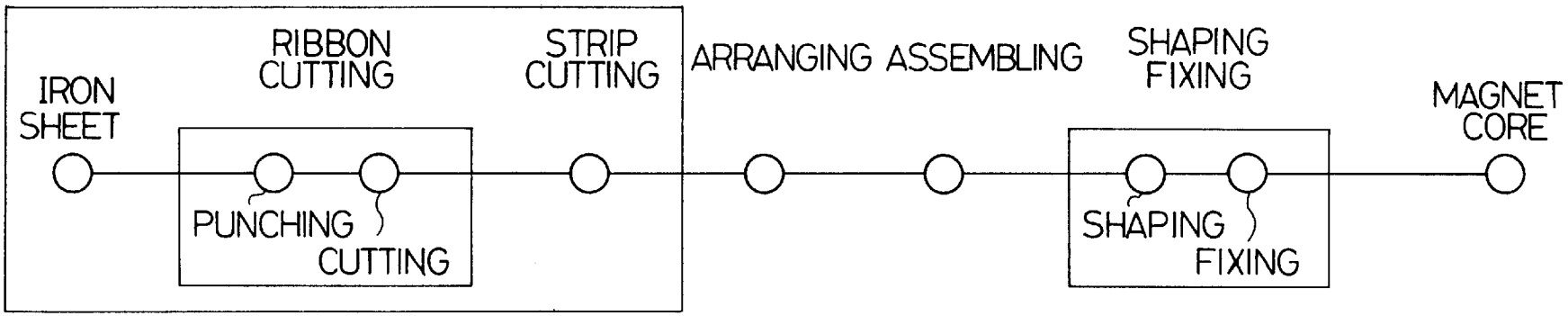
FIG. 7 is a diagram showing steps of manufacturing the magnetic core according to the present invention.

As shown in FIG. 7, a method of manufacturing the magnetic core 502 is composed of (1) a step of cutting an iron sheet 701 into a ribbon sheet 702 (2) a step of cutting the ribbon sheet 702 into a variety of strips 501*a*–501*z* shown in FIG. 5 and FIG. 6A, (3) a step of arranging each of the strips 501*a*–501*z* into a prescribed order, (4) a step of stacking the strips 501*a*–501*z* to form a strip assembly 707, and (5) a step of shaping the strip assembly 707 and welding end portions of the and assembly by a YAG laser.

(1) Ribbon Cutting

Figure 9:
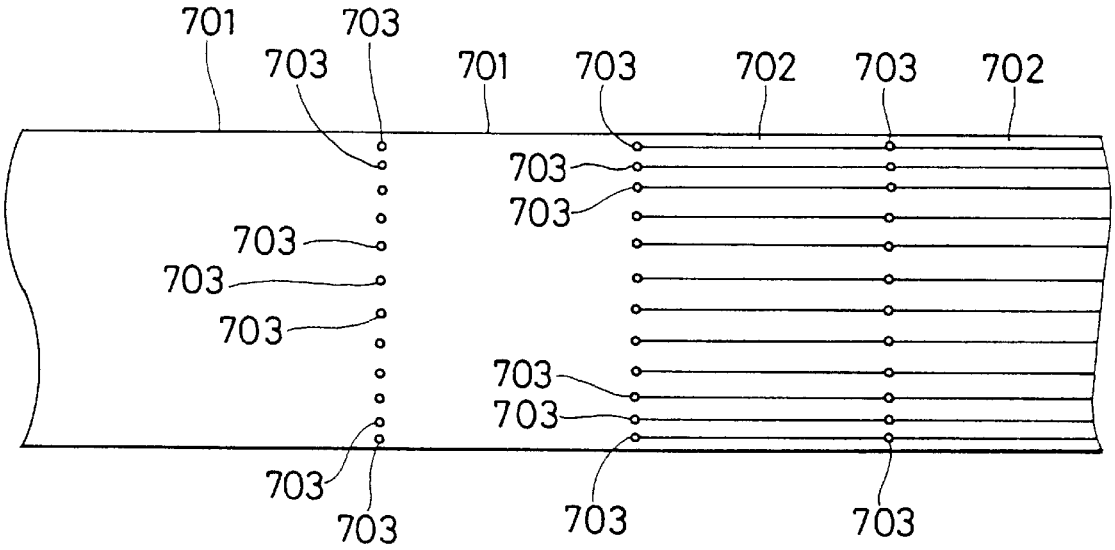
FIG. 9 is a schematic view illustrating a step of cutting iron strips from a band of an iron ribbon.

The step of ribbon cutting is composed of steps of punching tooling holes 703 in the longitudinal direction of the iron sheet and cutting the potions having the tooling holes from the iron sheet 701 shown in FIG. 9.

Figure 10:
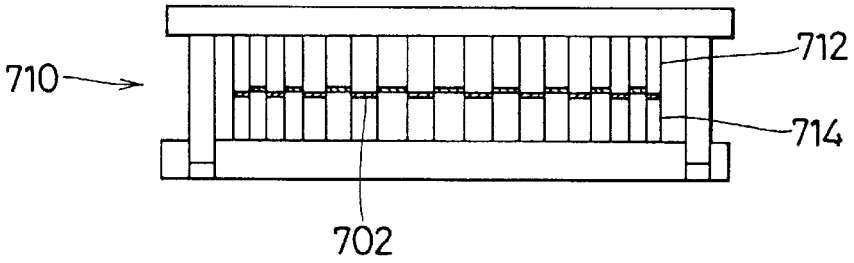
FIG. 10 is a schematic front view illustrating a cutting machine unit.
Figure 11:
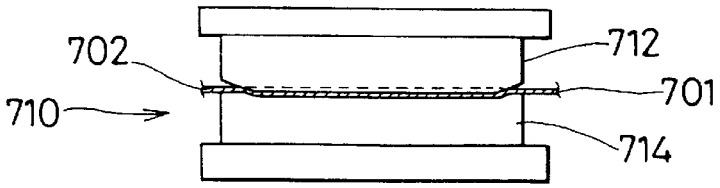
FIG. 11 is a schematic side view of the cutting unit shown in FIG. 10.

The tooling holes 703 are formed by a press machine 710 shown in FIGS. 10 and 11 at opposite sides of the sheet to be cut, that is, both sides of the ribbon. The tooling holes eliminate the cutting-size error and burs otherwise formed along the cut lines.

Figure 8:
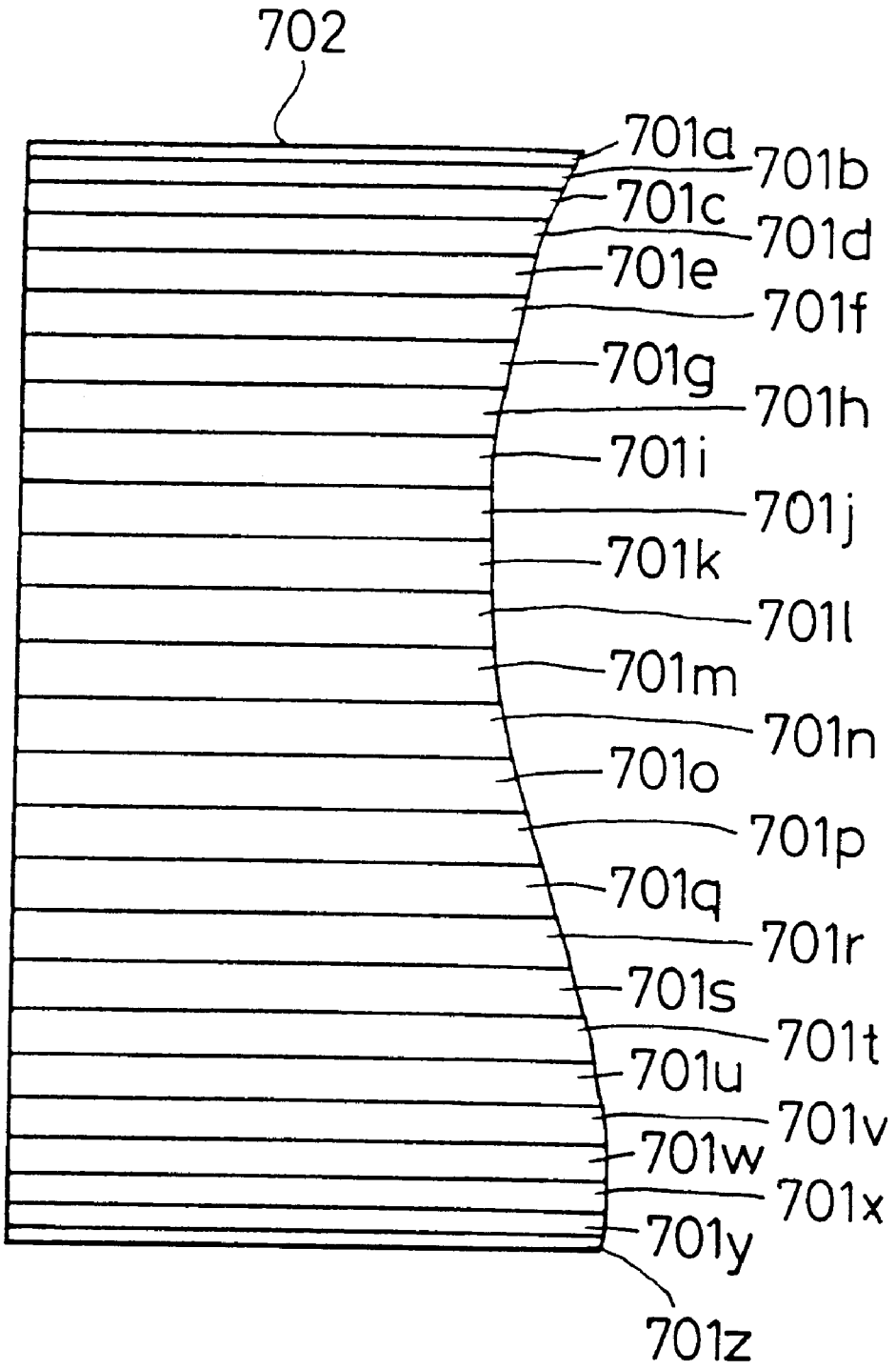
FIG. 8 is a schematic view showing variety of sizes of the iron strip to be cut.

The sheet 701 having the tooling holes 703 is cut to form a ribbon sheet 702 having a plurality of ribbons of a prescribed length and a variety of widths which increase toward the middle of the ribbon sheet 702. That is, the thinnest ribbons 701*a* and 701*z* are located respectively at opposite sides of the ribbon sheet 702, and the widest ribbons 701*m* and 701*n* are located at the middle of the ribbon sheet 702 as shown in FIG. 8.

Figure 12:
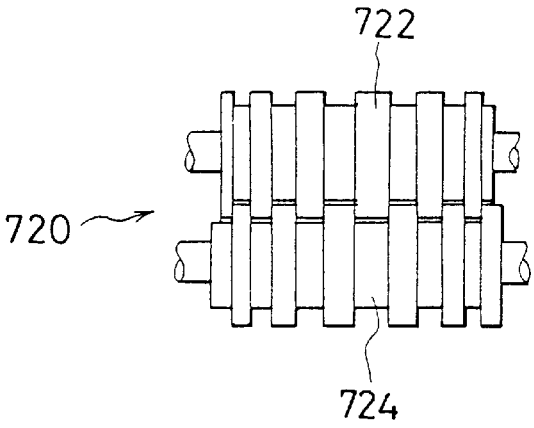
FIG. 12 is a schematic view illustrating another cutting machine unit.
Figure 13:
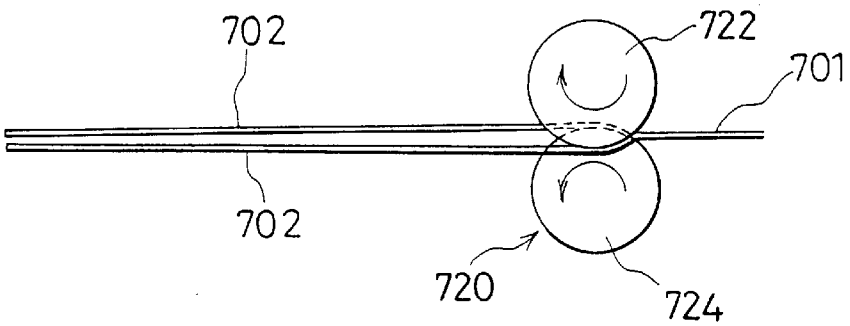
FIG. 13 is a schematic view showing a cutting step by the cutting machine unit shown in FIG. 12.

The ribbons are cut off by an upper cutting die 712 and a lower cutting die 714 of the press machine 710 shown in FIGS. 10 and 11. The ribbons can be cut off by a cutting machine 720 having rollers 722 and 724 as shown in FIGS. 12 and 13.

Instead of cutting the iron sheet into the ribbon sheet 702 as shown in FIG. 9, additional tooling holes are formed in parallel with the tooling holes 703 and an uncut band is formed between lines of the tooling holes 703 and the additional tooling holes. In this case, the ribbon sheet 702 can be sent to the next step without scattering.

(2) Strip Cutting

Figure 14:
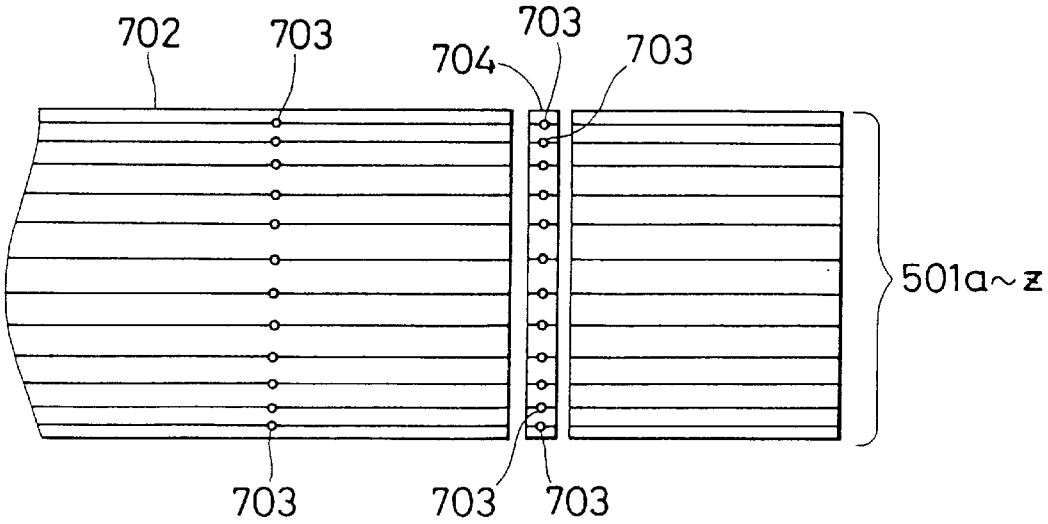
FIG. 14 is a schematic view illustrating an iron ribbon from which a plurality of strips are cut.

The cut ribbon sheet 702 is sheared off along lines in parallel with the tooling holes 703 to obtain each one of the strips 501*a*–501*z*, leaving portions 704 having the tooling holes 703 as shown in FIG. 14.

(3) Arranging of Strips

Each of the strips 501*a*–501*z* is placed on a table 731 of a piling machine 730 so that the narrowest strip 501*a* is is the rightmost on the table, and the widest strips, 501*m* and 501*n* are at the middle, and the narrowest strip 501*z* is the leftmost on the table 731 as described later in more detail.

(4) Assembling of Strips

The strips arranged on the table 731 of the piling machine 730 are piled up to form a generally cylindrical strip assembly with the narrowest strips 501*a* and 501*z* disposed on the top and bottom of the assembly and the widest strips 501*m* and 501*n* disposed at the middle thereof.

The piling machine 730 includes a main table 731, a pair of sliders 733, and a stopper 739. The main table 731 has a number of step-shelves 731*a* which corresponds to the number of strips 501*a*–501*z*. The surface of the main table 731 having the stepshelves 731*a* thereon angled upwards to the left at an angle θ1 with respect to a horizontal plane as indicated by a two-dot chain line A shown in FIG. 1 so that the strips may be held on the surface surely. The surfaces of stepshelves have almost the same shape as the strips. That is, the length (in the direction perpendicular to the line of the step shelves) of each of the shelves is almost the same as the length of the strips, and the width of each of the stepshelves is almost the same as (or slightly shorter than that of the strip to be placed thereon. The height of each of the steps is a little higher than the thickness of each of the strips 501*a*–501*z* so that each of the strips may be disposed in parallel with each other when they are gathered by the slider 733.

The slider 733 includes a carrier 735, a rotating shaft 736, and a driving motor 737. When the motor 736 rotates the shaft 736, the carrier 735, and consequently, the slider 733 slide along the line of the stepshelves on a pair of rails 734 attached to opposite sides of the table 731 as shown in FIG.

The slider 733 has a guide surface 733*a* which inclines at an obtuse angle θ2 with respect to the surface of the stepshelves 731*a* so that the strips gathered by the slider 733 can be lined up along the guide surface 733*a* surely.

Figure 1:
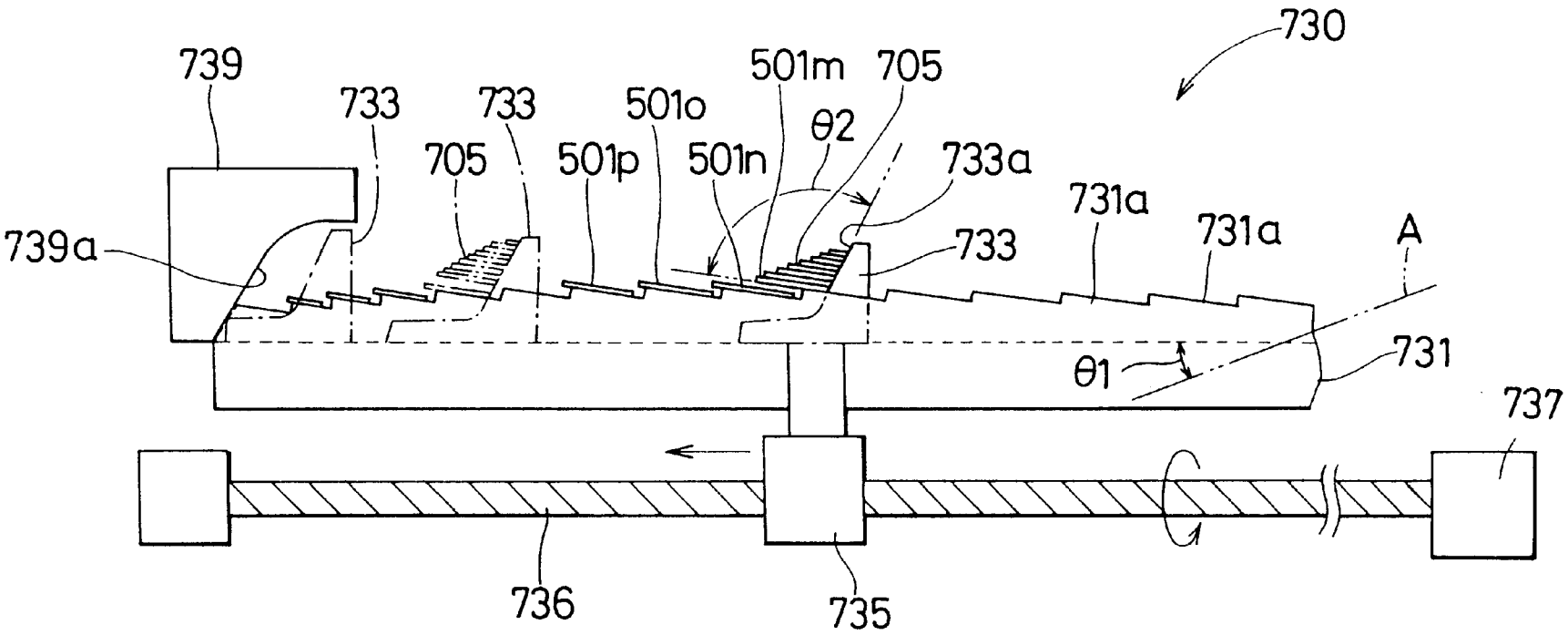
FIG. 1 is a schematic view illustrating an apparatus for manufacturing magnetic cores according to the present invention.
Figure 2:
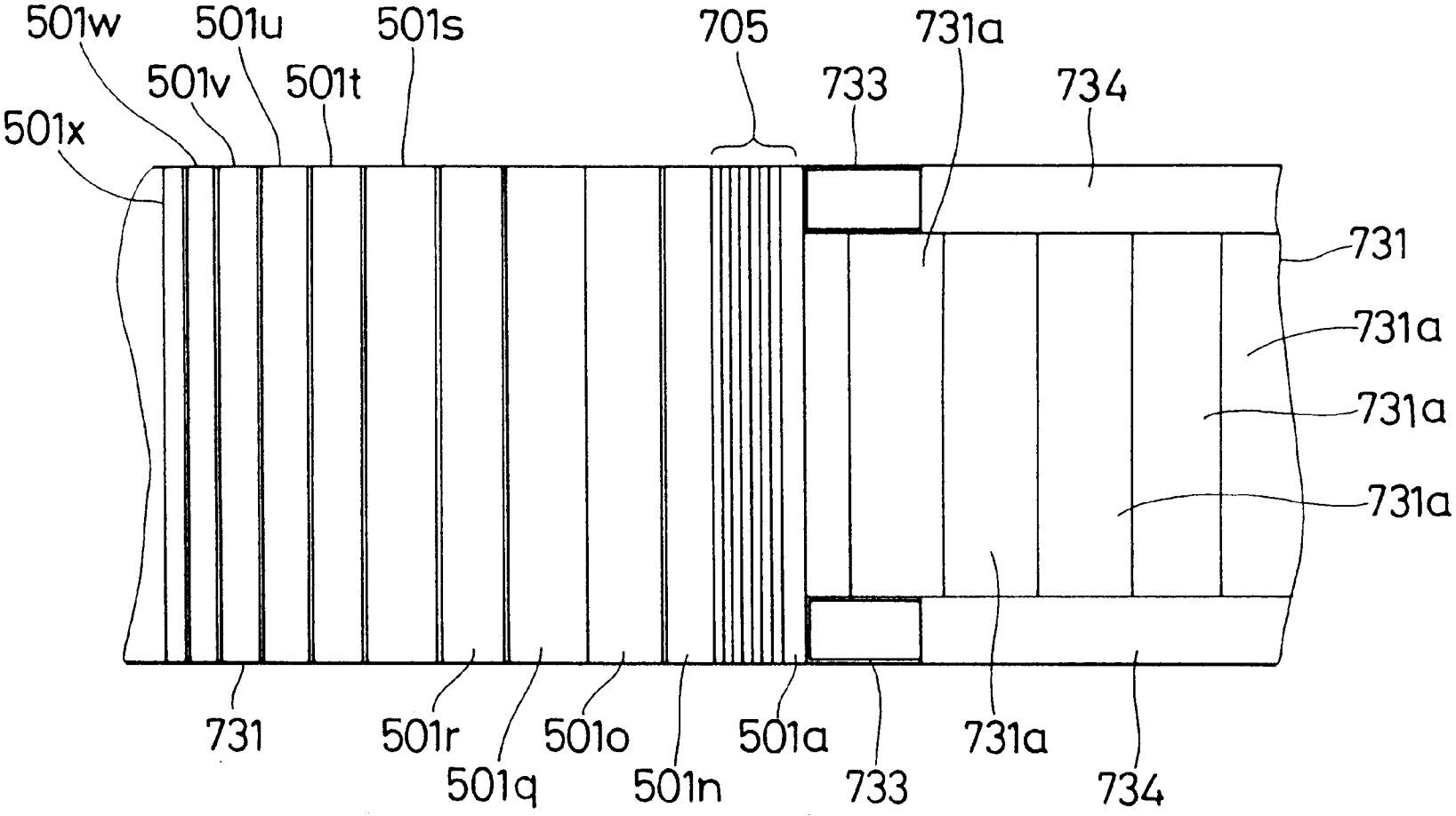
FIG. 2 is a schematic plan view of a main portion of the apparatus viewed from upper side in FIG. 1.

As shown in FIG. 1, when a pair of the slider 733 moves to the left (in a direction of stepping down the step-shelves

731*a*), a strip 501*n* on one of the shelves 731*a* is caught by the sliders 733 and pushed thereby to fall on a strip 501*o* on the next stepshelf 731*a* together with the strips 501*a*–501*m* which have been pushed and caught by the sliders 733.

Thus, all the strips 501*a*–501*z* are caught by the sliders 733 to form a layered body after the sliders 733 move to the stopper 739. The stopper 739 has a curved surface 739*a* facing the sliders 733. Therefore, when a pair of the sliders 733 is stopped by the stopper 739, the layered body 705 of the strips 501*a*–501*z* is pressed against the guide surface 733*a*.

(5) Shaping and Fixing

Figure 6B:
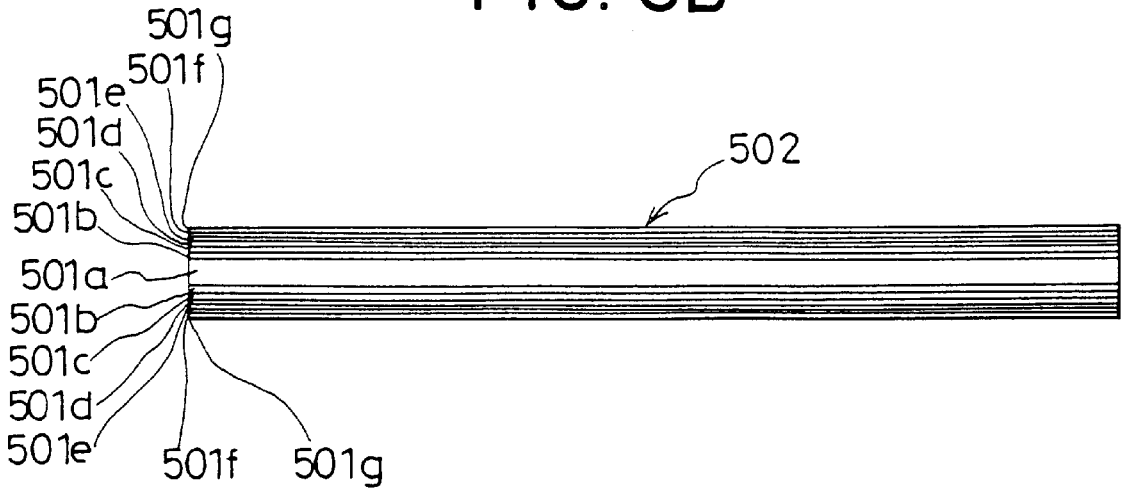
Figure 15:
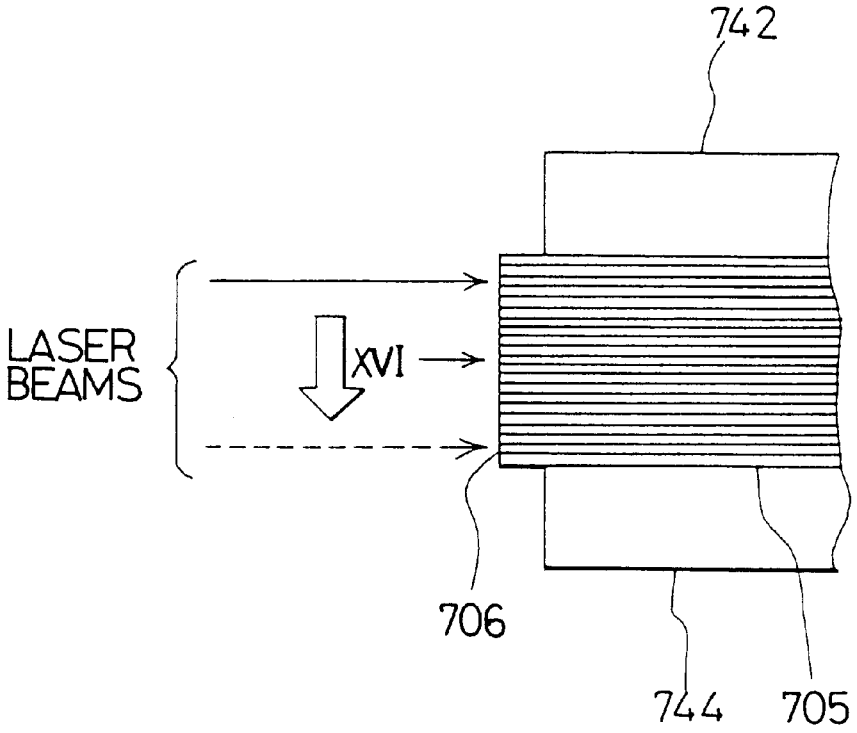
FIG. 15 is a magnetic core of laminated strips being welded by a YAG laser welder.
Figure 16:
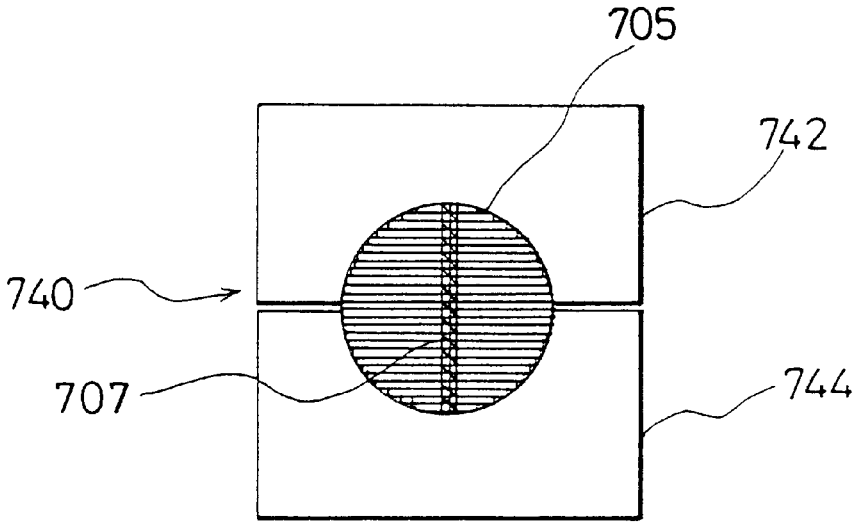
FIG. 16 is an plan view illustrating the magnetic core shown in FIG. 15 viewed from a side indicated by XVI therein.

As shown in FIGS. 15 and 16, the layered body 705 is put in a round bore of a shaping die 740 which includes an upper die 742 and a lower die 744 to shape the layered body 705 into a cylindrical strip assembly as shown in FIG. 6. The strip assembly is, thereafter, welded by a YAG laser at portions 707 across the end surfaces 706, thereby providing the cylindrical magnetic core 502.

The sliders 733 disposed at opposite sides of the stepshelves 731*a* can be replaced with a slider disposed at the middle of the stepshelves 731*a*.

A combination of the fixed table 731 and the moving sliders 733 can be replaced with a combination of a moving table and a fixed slider or the like.

The strip assembly can be provided by using a belt conveyor and a receptacle disposed at a place near the forward end of the conveyor. In this case the strips 501*a*–501*z* are placed in the order as described before and carried by the conveyor to the forward end thereof to fall on the receptacle one by one until all of them pile up.

The strips can be cut transversely from an iron sheet which has the same width as the length of the strips. The strips can be also cut longitudinally from a plurality of iron sheets having a variety of widths.

In the foregoing description of the present invention, the invention has been disclosed with reference to specific embodiments thereof. It will, however, be evident that various modifications and changes may be made to the specific embodiments of the present invention without departing from the broader spirit and scope of the invention as set forth in the appended claims. Accordingly, the description of the present invention in this document is to be regarded in an illustrative, rather than restrictive, sense.

What is claimed is:

1. An apparatus for manufacturing a magnetic core comprised of laminated iron strips, said apparatus comprising:

a table for placing a plurality of iron strips in a prescribed order;

a stacker for stacking said iron strips in said prescribed order;

a mover for moving said stacker relative to said table to supply said iron strips one by one to said stacker, said table having a surface angled upwards relative to a horizontal plane in a moving direction of said stacker.

2. An apparatus for manufacturing a magnetic core as claimed in claim 1, wherein said table comprises a plurality of stepshelves for holding each one of said strips in said prescribed order; and said stacker comprises a slider having a guide surface for catching one of said strips and stacking said one strip when said slider is moved to one of said stepshelves by said mover.

3. An apparatus for manufacturing a magnetic core as claimed in claim 2, said apparatus further comprising:

a stopper for stopping said slider to shape said stacked strips into a prescribed shape.

4. An apparatus for manufacturing a magnetic core as claimed in claim 2, wherein said guide surface has a portion angled at an obtuse angle relative to a surface of said stepshelves.

5. An apparatus for manufacturing a magnetic core as claimed in claim 2, said apparatus further comprising:

a cutting machine for cutting an ion sheet into each one of said iron strips to form a generally cylindrical core when assembled;

a shaping die for shaping said piled iron strips into a cylindrical core; and a welder for welding said cylindrical core.

6. An apparatus for manufacturing a magnetic core as claimed in claim 1, wherein said stacker comprises a slider having a curved guide surface for catching one of said strips and stacks said one strip when said slider is carried to one of said stepshelves by said mover.

7. An apparatus for manufacturing a magnetic core as claimed in claim 3, wherein said stopper has a curved surface facing said slider for pressing said stacked strips against said guide surface.

* * * * *